United States Patent [19]

Chayer

[11] 4,068,321

[45] Jan. 17, 1978

[54] ADJUSTABLE PANTS

[75] Inventor: Brigitte S. Chayer, Arvida, Canada

[73] Assignee: Robert Laliberte, Chicoutimi, Canada

[21] Appl. No.: 616,444

[22] Filed: Sept. 24, 1975

[51] Int. Cl.[2] ..... A41D 1/06

[52] U.S. Cl. ..... 2/227; 2/234; 2/237

[58] Field of Search ..... 2/234, 235, 227, 237, 2/221, DIG. 6, 405

[56] References Cited

U.S. PATENT DOCUMENTS

| | | | |
|---|---|---|---|
| 191,505 | 5/1877 | Zoellner | 2/237 |
| 403,457 | 5/1889 | Brown | 2/237 |
| 666,246 | 1/1901 | Henderson | 2/234 X |
| 1,858,201 | 5/1932 | Kimmel | 2/227 |
| 2,113,732 | 4/1938 | Koppel | 2/227 |
| 2,336,554 | 12/1943 | Lippmann | 2/234 |
| 2,636,180 | 4/1953 | Gillespie et al. | 2/221 X |
| 2,661,477 | 12/1953 | Gilbertson | 2/221 |
| 3,431,562 | 3/1969 | Souders | 2/221 |
| 3,823,419 | 7/1974 | Breithart | 2/237 |

OTHER PUBLICATIONS

"Wardrobe Aids Being Developed for Stroke Paralysis Victims"; Morganton, N.C. News-Herald; July 13, 1970.

*Primary Examiner*—H. Hampton Hunter
*Attorney, Agent, or Firm*—Roland L. Morneau

[57] ABSTRACT

A pair of pants having an adjustable lower body portion made of two overlapping frontal triangular flaps extending from the back and sides of the body portion. The triangular flaps have their apex at about the crotch of the body wearing the pants and their base at about the waist of the said body, the free side of each flap is adapted to be normally directed diagonally in the general direction of the side of the hips. The forward flap is provided with a set of buttonholes along its free side and the rearward flap is provided with a set of displaceably fixed buttons in positions corresponding to the said buttonholes. The overlapping surfaces of the two flaps may vary in dimensions by being pivoted about their apex and accordingly adjust to the girth of the lower body. The buttons are displaceably fixed to the rearward flap along a radial line having its center about the said apex and corresponding to the position of the buttonholes.

3 Claims, 5 Drawing Figures

ADJUSTABLE PANTS

The present invention relates to an improvement in slacks, shorts, skirts, pants or the like and is particularly directed to an arrangement for adjusting the waist line and the lower part of the body such as an increase or a reduction of the size of the abdomen and in particular in the case of a maternity.

The intent of the invention is to provide a garment which can be adapted to the variation of the waist line and the size of the abdomen while maintaining a neat and beautiful appearance and providing a firm support for the abdomen.

The pants or skirts, according to the present invention are provided with a pair of overlapping triangular flaps which can be fixed in a variety of fan-like positions according to the wish of the wearer. Prior inventions have been patented for similar purposes but the arrangements foreseen did not provide the results expected by the present applicant.

Canadian application No. 428,553, issued to A. J. Bono, on Sept. 13, 1943 describes a frontal flap which opens along a horizontal line and buttons up around the waist. It is not intended to provide a support for the abdomen because there is no fastening means provided between the belt portion and the lower part of the flap.

Similarly, in U.S. Pat. No. 1,998,865, issued to A. Fekete on Apr. 23, 1935, adjustable pants had been described wherein the only points of attachment are provided around the waist-belt.

In the garment, according to the present invention, an adjustable lower body portion is provided by being characterized by two overlapping frontal trianguloid flaps extending from the side parts of the back and side portions of the garment, the trianguloid flaps being adapted to have their apex at about the crotch of the body wearing the said garment and their base at about the waist of the body, the free side of each flap being adapted to be normally directed diagonally in the general direction of the side of the hips, fastening means extending between the apex and the said base and mounted on the forward and rearward flaps for releasably fixing the forward flap over the rearward flap in a plurality of fan-like positions, whereby the overlapping surfaces of the two flaps may vary in dimensions by being pivoted about their apex and accordingly adjust to the girth of the lower body, whereby the fastening means are displaceably fixed on the flaps along a radial line having its center about the apex of the flaps.

The fastening means is particularly contemplated in a simple manner by a set of buttonholes along the free side of the forward flap and with a set of displaceably fixed buttons in the rearward flap in positions corresponding to the said buttonholes.

Other fastening means such as felt-like adhesives such as known by the trademark "Velcro" and slide fasteners may also be used.

Figure 1:
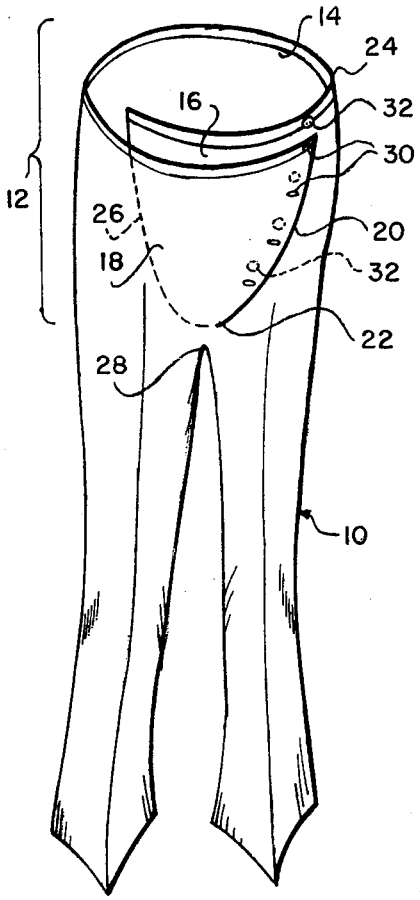
Figure 2:
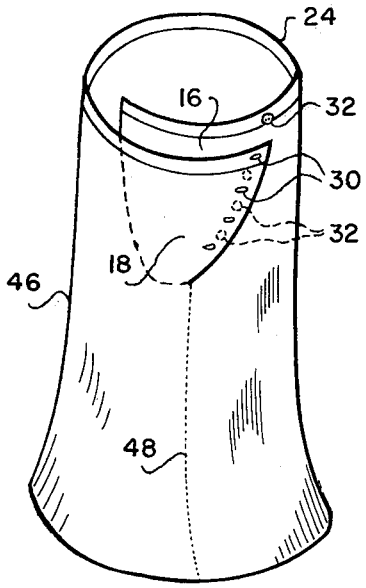
Figure 3:
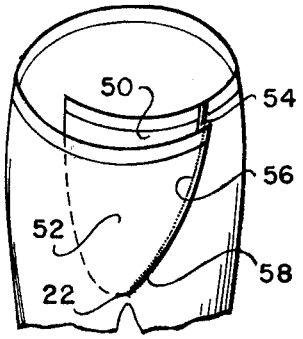
Figure 4:
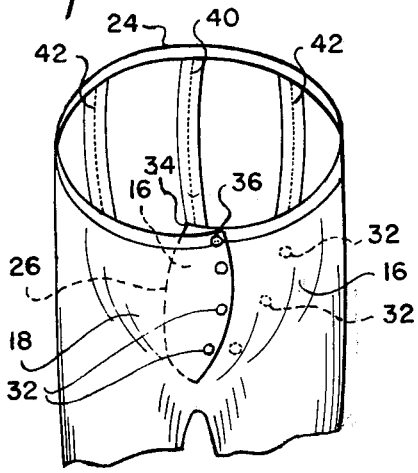
Figure 5:
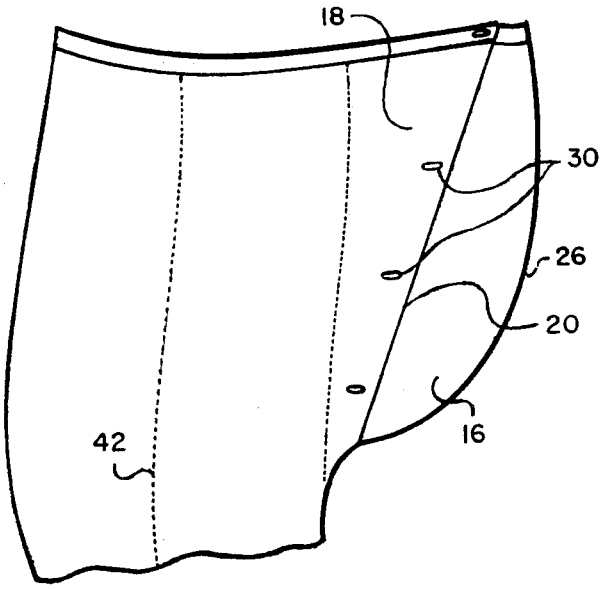

The invention will now be described in greater details by referring to the drawings wherein, FIG. 1 is a front perspective view of a pair of slacks embodying the invention, FIG. 2 is a front perspective view of a skirt embodying the invention, FIG. 3 is a front perspective view of the upper part of a pair of slacks showing a different embodiment of the invention, FIG. 4 is a perspective view as shown in FIG. 1 with little overlapping of the front flaps, and FIG. 5 is a side view of the upper part of the slacks shown in FIG. 1 with the flaps projecting forwardly.

FIG. 1 shows a pair of slacks 10 having an upper body portion 12 comprising a back part 14 extending from one side to the other and two overlapping frontal trianguloid flaps 16 and 18 extending from the back and side parts of the upper body portion 12. The forward flap 18 has a free side 20 extending diagonally from the apex 22 of the trianguloid flap 18 in the direction of the hip of the waist-belt 24 of the slacks 10. The rearward flap 16 has a free side 26 which is preferably outwardly curved from the apex 22 to the waist-belt 24 in the general direction of the hip of the body wearing the slacks and corresponding to the side of the waist-belt 24.

The apex 22 is the same for both flaps 16 and 18 so that both may pivot from the same point 22. The apex 22 is located slightly above the crotch 28 of the slacks 10 especially because the crotch has a certain length extending between the front and the rear part of the body wearing the slacks.

The forward flap 18 is provided with four bottonholes 30 disposed along the free side 20. One buttonhole is preferably located in the waist-belt 24. The rear flap 16 is provided with a corresponding number of buttons 32 so as to be inserted in the buttonholes 30. The distance between each button and each buttonhole is such so as to maintain both flaps firmly in contact with each other.

This pair of slacks, made according to the present invention may be used for a person increasing in size especially around the abdomen and more particularly for a woman during her maternity period. Periodically, when the size of the abdomen increases, the buttons 32 are removed from their original positions and displaced step by step towards the free side 26 of the rearward flap 16 along a radial line having its center at the apex 22. This procedure is very simple considering that the person merely puts the slacks on and adjusts the position of the buttons according to the present state of his or her abdomen.

Although the material used for this kind of slacks is not a restrictive characteristic, it has been found preferable to use a non-stretching material which will permit a firm retention of the abdomen while providing a neat appearance.

When the slack has practically reached its full circular dimension, it substantially resembles the appearance shown in FIG. 4. In this position, the upper corner 34 of the rearward flap 16 and the upper corner 36 of the forward flap 18 may slightly point upwardly and the buttons 32 will have then be moved close to the free side 26 of the rearward flap 16.

It should be remembered that the abdomen forms a convex protuberance which substantially maintains the waist-belt 24 along the same horizontal plane. It is on account of this convexity that the free side is curved outwardly.

FIG. 4 shows in dotted lines the buttons 32 position in substantially the original position shown in FIG. 1. For the purpose of realizing the extent of the increase of the abdomen, the rear seam 40 and the side seams 42 are illustrated. It may be realized that a large portion of the circumference of the waist-belt 24 is located forwardly of both side seams 42.

FIG. 5 illustrates the pair of slacks in a side view when the slacks are laid flat on a table and when the flaps project forwardly one against the other. FIG. 5 also illustrates that the free side 26 of the flap 16 projects forwardly of the free side 20 of the flap 18 and accordingly is wider. This arrangement is preferred so as to take up the protuberance of the abdomen when both flaps 16 and 18 are only slightly overlapping. Considering the convexity of the abdomen, the buttons could be sewn close to the free side 26 of the flap 16.

The invention as described above may also be used for a skirt as illustrated in FIG. 2. The skirt 46 may be made of a piece of material forming substantially a cylindrical sleeve having a seam along the line 48, the material could extend into both flaps 16 and 18 substantially as illustrated and described for FIG. 1.

FIG. 3 illustrates the upper part of a pair of slacks wherein the fastening means between the rearward flap 50 and the forward flap 52. It consists of a slide fastener having two sets of interlocking tongues 54 and 56 which can be interlocked by the slider 58. When the size of the abdomen increases, the set of interlocking tongues 54 is moved along a radial line from the apex 22. As it is well known for slide fasteners, these interlocking tongues are mounted on a piece of cloth which can be sewn and unsewn from one position to another position.

The fastening means which serves to hold the forward and rearward flaps may also be constituted of two pieces of felt-type adhesives known by the trade-mark "Velcro". Such felt-type adhesive is made of a multiplicity of contiguous short needle-type filaments. The needle-type filament of one adhesive is adapted to penetrate between the filaments of the other adhesive and be retained thereto.

The fastening means may also be constituted of small wire hooks sewn to the material.

Although the embodiments illustrated in FIGS. 1, 2, 4 and 5 show four buttons, it is obvious that the number of buttons may vary according to the adjustment desired.

What I claim is:

1. A pair of adjustable maternity pants made of substantially non-stretchable material, comprising a lower body wrapping section having a rear part and two frontal upper flaps adapted to overlap upon each other over the abdomen of the body, each flap being trianguloid in shape and extending from the side of the said rear part, the said trianguloid flaps being fixed to each other at a point corresponding to their apex and adapted to have the said apex at about the crotch of the body wearing the said pants and the base of said trianguloid at about the waist of said body, the free side of each flap being adapted to be normally directed diagonally in the general direction of the side of the hips, the free side of the rearward flap being generally outwardly curved, fastening means extending between the apex and the said base and mounted on the forward and the rearward flaps for releasably fixing the forward flap over the rearward flap, the said fastening means comprising two releasably connected parts, one of said parts being permanently provided along the edge of the forward part and the other of said parts being releasably fixed to the rearward flap, in a position corresponding to the convexity of the abdomen, whereby the said other part of said fastening means is adapted to be displaceably fixed to the rearward flap along a radial line having its center at about the said apex of the flaps, to allow the two flaps to overlap in a plurality of fan-like positions to adjust to a plurality of convex protuberances of the abdomen while providing a firm sidewise and forward support for the abdomen in each position.

2. A combination as recited in claim 1, wherein the apex of the flaps being adapted to be located in a position above the crotch of the body wearing the said pants.

3. A combination as recited in claim 1, wherein the fastening means comprises a set of buttonholes provided along the free side of the said forward flap, and a set of displaceably fixed buttons provided in positions corresponding to the said buttonholes, whereby the buttons displaceably fixed to the rearward flap along a radial line having its center about the said apex and corresponding to the position of the said buttonholes.

* * * * *